US005096073A

United States Patent [19]

O'Brien

[11] Patent Number: 5,096,073

[45] Date of Patent: Mar. 17, 1992

[54] DISPLAY TUBE

[75] Inventor: Paul. O'Brien, Seal Beach, Calif.

[73] Assignee: O.B.I., Inc., Cypress, Calif.

[21] Appl. No.: 744,294

[22] Filed: Aug. 13, 1991

[51] Int. Cl.[5] ..... B66C 13/12

[52] U.S. Cl. ..... 211/163; 211/167; 229/5.5; 229/125.17; 40/539

[58] Field of Search ..... 229/5.5, 125.17, 165; 211/70, 71, 70.1, 59.1, 167, 72, 73, 163, 135; 40/539 T

[56] References Cited

U.S. PATENT DOCUMENTS

| | | | |
|---|---|---|---|
| 2,341,374 | 2/1944 | Gardner | 229/5.5 |
| 2,726,803 | 12/1955 | Ketler | 229/5.5 |
| 2,736,486 | 2/1956 | Rabby | 229/5.5 |
| 3,349,986 | 10/1967 | Chapman et al. | 229/5.5 X |
| 3,366,496 | 1/1986 | Bomar et al. | 229/165 |
| 4,126,366 | 11/1978 | Handler et al. | 211/163 X |
| 4,567,996 | 2/1986 | Muise | 229/165 |

*Primary Examiner*—Blair M. Johnson
*Assistant Examiner*—Korie H. Chan
*Attorney, Agent, or Firm*—Poms, Smith, Lande & Rose

[57] ABSTRACT

A display tube having a hollow elongated upright main body portion with a plurality of spaced slots for receiving display hooks therein. A plurality of hinged foldable flaps are provided at the top and bottom of the main body portion. Each flap has a first portion that folds about a second portion, the second portion then folding again into the interior of the main body portion. These flaps portions have cut out sections so that, when the flaps are so folded, a plurality of spaced cutout areas are provided about the inner periphery of the main body portion. An insert or panel can be inserted into the interior of the main body portion after folding the flaps. A hole in the insert can receive a pole of a rotatable stand therethrough.

8 Claims, 2 Drawing Sheets

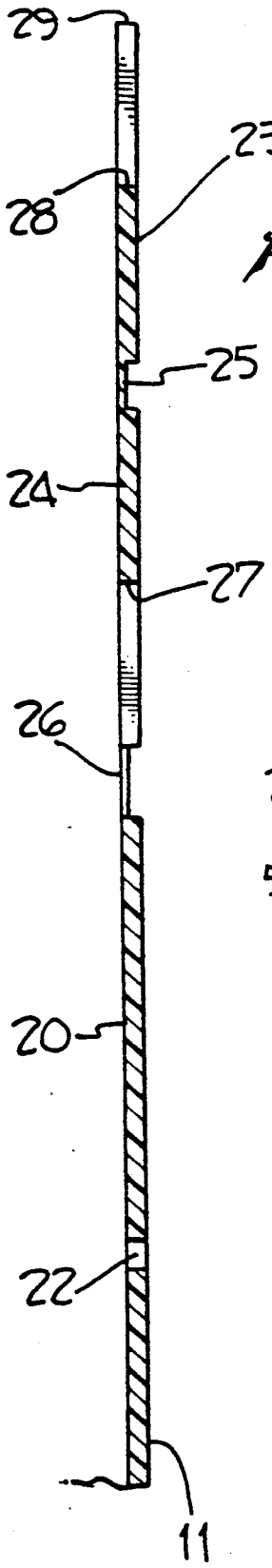
Fig. 2.
Fig. 3.
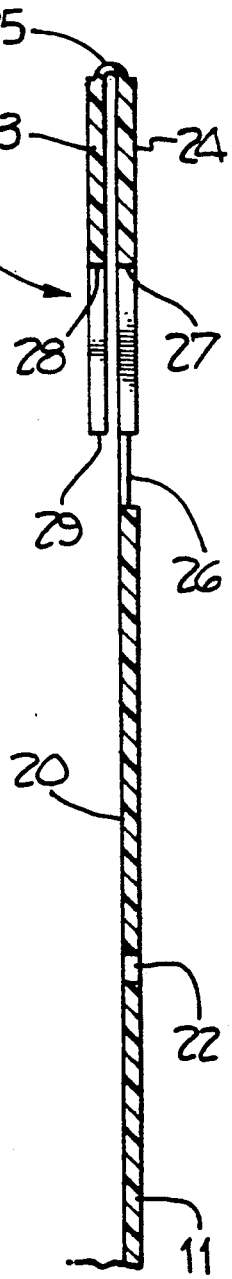
Fig. 6.
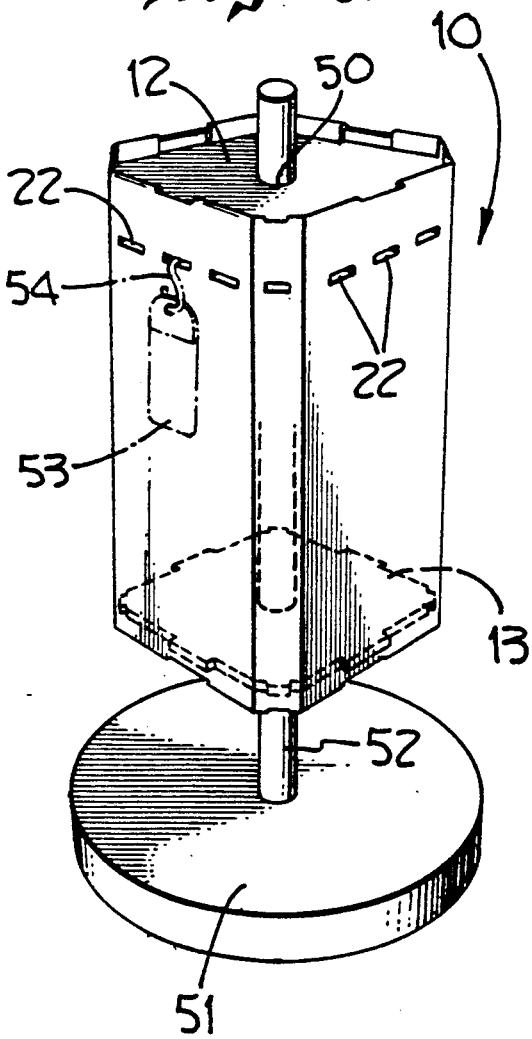

DISPLAY TUBE

BACKGROUND OF THE INVENTION

1. Field of the Invention

The invention relates to display devices and, more particularly, to an easily assemblable sturdy display tube.

2. Description of the Prior Art

Display devices are well known in the art. Such devices are usually made of cardboard or the like, assembled from a plurality of interconnecting parts and are sturdy enough to support an attachment or a plurality of attachments to the display device.

There is a need for a display which is simple to manufacture and assemble. Such a device should be sturdy enough to be reusable and support a plurality of items thereon.

SUMMARY OF THE INVENTION

It is an object of this invention to provide an improved display tube.

It is a further object of this invention to provide a display tube which can take a variety of configurations and receive a pole therethrough for allowing the tube to be displayed on a rotating surface.

It is still further an object of this invention to carry out the foregoing objects in a display tube that is sturdy yet simple and easy to manufacture and assemble.

These and other objects are preferably accomplished by providing a display tube having a hollow elongated upright main body portion with a plurality of spaced slots for receiving display hooks therein. A plurality of hinged foldable flaps are provided at the top and bottom of the main body portion. Each flap has a first portion that folds about a second portion, the second portion then folding again onto the interior of the main body portion. These flaps portions have cut-out sections so that, when the flaps are so folded, a plurality of spaced cut-out areas are provided about the inner periphery of the main body portion. An insert or panel can be inserted into the interior of the main body portion after folding the flaps. A hole in the insert can receive a pole of a rotatable stand therethrough.

BRIEF DESCRIPTION OF THE DRAWING

FIG. 2 is a view taken along lines 2—2 of FIG. 1;

FIG. 3 is a side sectional view of a portion of the display tube of FIG. 1 showing a first folding of the upper flanges of the tube;

FIG. 6 is a perspective view of the assembled display tube of FIG. 1 to 3 mounted on a display stand.

DESCRIPTION OF THE PREFERRED EMBODIMENT

Figure 1:
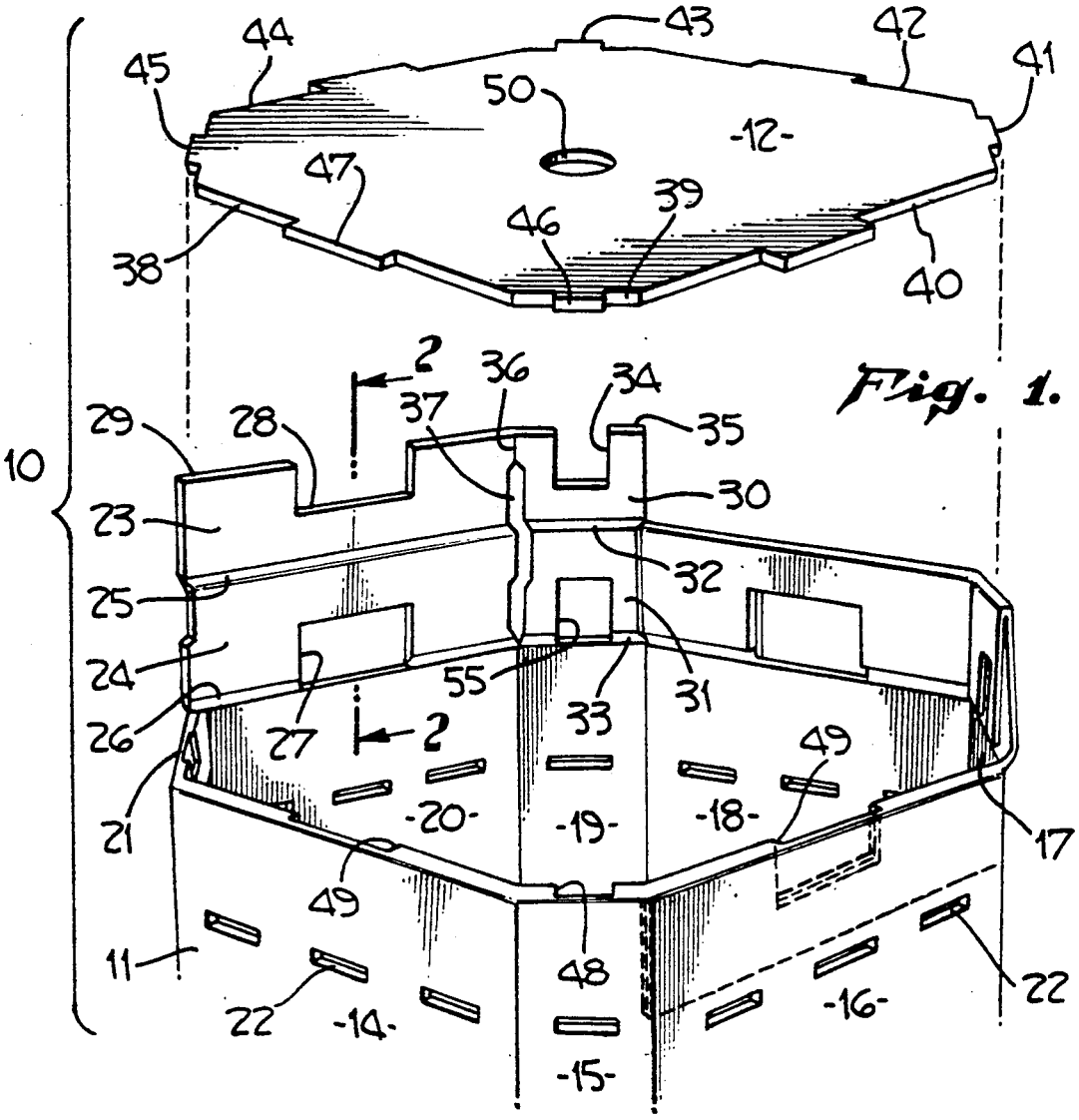
FIG. 1 is an exploded view of a portion of a display tube in accordance with the teachings of the invention prior to assembly thereof.

Referring now to FIG. 1 of the drawing, a display tube 10 as shown in partial exploded view comprised of a main tubular body portion 11, an upper insert panel 12 and a like lower insert panel 13 (insert 13 is shown in dotted lines in FIG. 6 installed on body portion 11).

Main body portion 11 is shown as hexagonally shaped in cross section being comprised of side panels 14 through 21, respectively. Panels 14, 16, 18, and 20 may be generally of the same overall width. Panels 15, 17, 19 and 21 may also be generally of the same overall width but lesser in width than panels 14, 16, 18 and 20. Although a tube 10 hexagonally shaped in cross-section is disclosed, obviously any suitable cross section may be provided. Further, main body portion 11 may be formed from a single blank of a suitable material, such as corrugated cardboard, or plastic, then rolled or otherwise set up as in FIG. 1. Of course, body portion 11 can also be of wood, metal, etc. However, as particularly contemplated in the invention, and as will heretofore be described, preferably body portion 11 is of a material whereby the insert retaining means to be discussed is an integral foldable portion of main body portion 11.

A plurality of rectangular spaced through slots 22 are provided about main body portion 11. These slots are adapted to receive display hooks therein, of any suitable type.

One suitable type of display hook that can be used are the hooks disclosed in U.S. Pat. No. 4,671,417, to Paul O'Brien, assigned to O.B.I. Co.

A plurality of folded flaps are provided about the periphery of each end of main body portion 11 (identical flaps are provided at top and bottom; for convenience of illustration, only the flaps at the top of main body portion 11 are shown in FIG. 1.)

Thus, a first set of foldable flaps 23, 24 are shown associated with panel 20. Flap 23 is hinged to flap 24 along hinge line 25 and flap 24 is hinged to panel 20 along hinge line 26. A cut-out portion 27 is provided in flap 24, about midway across the same, having its open end terminating at hinge line 26. A like cut out section 28 is provided in flap 23, about midway across the same, having its open end terminating along outer edge 29. The intersection of edge 29 and section 28 may be rounded, if desired.

A second set of foldable flaps such as flaps 30, 31 are provided associated with panel 19, flap 30 being hinged to flap 31 along hinge line 32 and flap 31 being hinged to panel 19 along hinge line 33. A cut out section 34 is provided in flap 30, about midway across the same having its open end terminating at outer edge 35. A cut out section 55 is provided in flap 31 about midway across the same, having its open end terminating at hinge line 33. Again, the intersection of edge 35 and section 34 may be rounded, if desired.

Flap 30 is also hinged to flap 23 at hinge line 36. As seen in FIG. 1, a cut-out area 37 is provided between flaps 23, 24, on one hand, and flaps 30, 31, on the other hand, irregularly configured, as shown.

Insert panel 12 (panel 13 being identical) is hexagonally shaped in outer configuration similar to the internal contour of main body portion 11. Thus, panel 12 has elongated sides 38 through 45. Sides 38, 40, 42 and 44 are of the same length and generally related to the length of sides 14, 16, 18 and 20 (thereby coinciding therewith). Sides 39, 41, 43 and 45 are also of the same length (less than the length of sides 38, 40, 42 and 44) and generally related to the length of sides 15, 17, 19 and 21 (thereby coinciding therewith).

Sides 39, 41, 43 and 45 each have an ear or tab, such as tab 46 on side 39, of substantially the same (or slightly less than the) width as cut-out sections 34 in flaps 30.

Sides 38, 40, 42 and 44 each have an ear or tab 47 of substantially the same width (or slightly less than) of cut-out sections 28 in flaps 23.

Figure 4:
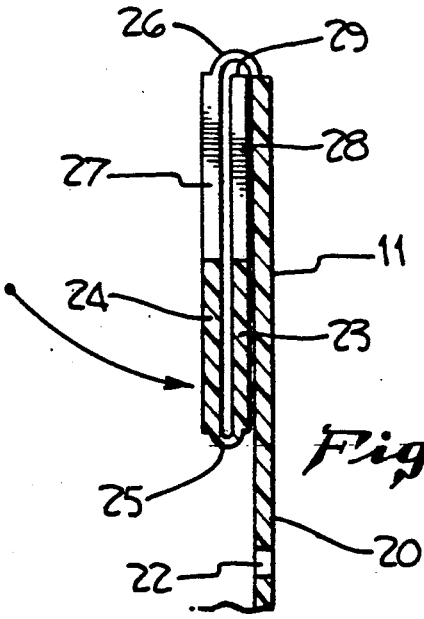
FIG. 4 is a side sectional view of a portion of the display tube of FIG. 1 showing a second or subsequent folding of the upper flanges of the tube.

As seen in FIG. 2, flaps 23, 30 are folded first about hinge lines 25, 32 and against lower flaps 24, 31, as shown in FIG. 3. As seen in FIG. 4, the folded flaps 23, 24, 30, 31 are then folded again about fold lines 26, 33. As seen in FIG. 1, such folding results in upwardly opening slots 48 formed in twice folded panels 30, 31 (slots 48 being formed by the engagement of cut-out sections 34,35).

In like manner, slots 49 are formed in twice folded panels 23, 24 by the alignment of cut-out sections 27,28.

Figure 5:
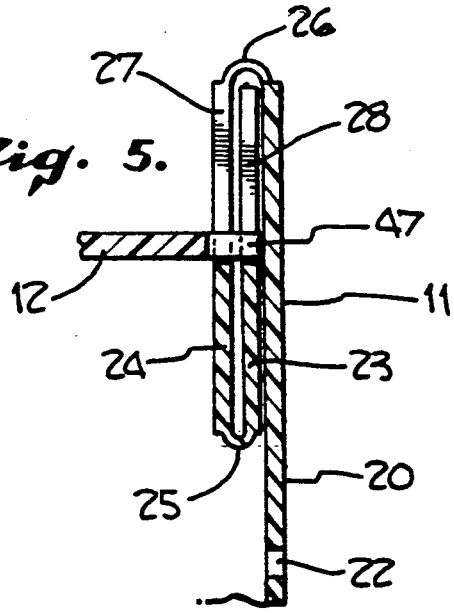
FIG. 5 is a view similar to FIG. 4 showing the panel 12 of FIG. 1 mounted therein.

Insert panel 12 (FIG. 1) is now pushed down inside of main body portion 11 with tabs 47 entering slots 49 and tabs 46 entering slots 48. Panel 12 is pushed inwardly until it reaches the bottom of slots 48, 49 (see FIG. 5).

Thus, both insert panels 12, 13 are assembled to main body portion 11. Each panel 12, 13 may have a centrally located hole 50 therein. As seen in FIG. 6, a rotatable base 51 of any suitable type, such as a lazy susan type base, is provided having a centrally disposed upright pole 52. Tube 10 is placed onto base 51 with pole 52 entering the aligned holes 50 in upper and lower panels 12, 13. In this manner, tube 10 can be rotated, manually or electronically, to present differing sides thereof thus varying the display of any items 53 mounted on hooks 54 inserted in slots 22.

The main body portion 11 can be a flat piece of material rolled into the configuration of FIG. 1, then glued, stitched or stapled together. Although flaps 23, 24 are shown hinged to flaps 30, 31, respectively (forming a pair of foldable sections), obviously subsequent adjacent flaps can be so hinged as long as the flaps can be folded as discussed with respect to FIGS. 2 to 4. The tube 10 can be of any suitable cross-section, square, hexagon, octagonal rectangular, round, etc. 25 and of any suitable dimension, for example, flaps 23, 24 may be about 16" long and about 4" high with cut-out sections 27, 28 about 6" long and 2" high. Flaps 30, 31, may be about 8" wide and 4" high with cut-out sections 34, 55 being about 3" long and 2" high. Tube 10 may be about 12" in diameter and about 40" high.

Any suitable materials may be used, such as die cut corrugated cardboard, wood, plastic, etc.

It can be seen that I have disclosed a display tube that can be manufactured and assembled in a quick and inexpensive manner. The resulting tube is sturdy having a panel support 12, 13 at top and bottom retained in place by the folded flaps.

I claim:

1. A display tube comprising:

a main body portion having a plurality of interconnected sides and open at top and bottom forming a hollow tube with a throughbore therethrough;

a first flap hingedly connected along a first hinge line to one of said interconnected sides; said first flap having a pair of vertical side edges extending upwardly on each side of said first hinge line.

a second flap hingedly connected along a second hinge line to a second of said interconnected sides adjacent said one of said interconnected sides, said second hinge line being coincident with said first hinge line;

a third flap hingedly connected along a third hinge line to said first flap, said third flap having a pair of spaced vertical side edges extending upwardly on each side of said third hinge line, said third flap also having a cut-out section having a horizontal bottom edge spaced from said third hinge line and a pair of spaced vertical side edges interconnected to said bottom edge of said third flap cut-out section on each side of said bottom edge and spaced between the vertical side edges of said third flap;

said first flap having a cut-out section therein having a horizontal bottom edge spaced from said third hinge line and a pair of spaced vertical side edges interconnected to said bottom edge of said first flap cut-out section of each side of said bottom edge and spaced between the vertical side edges of said first flap, said cut-out section of said first flap aligning with the cut-out section of said third flap when said third flap is folded along said third hinge line against said first flap;

a fourth flap hinged connected along a fourth hinge line to said second flap, said fourth flap having a pair of spaced vertical side edges extending upwardly on each side of said fourth hinge line, said fourth flap also having a cut-out section having a horizontal bottom edge spaced from said fourth hinge line and a pair of spaced vertical side edges interconnected to said bottom edge of said fourth flap cut-out section on each side of said bottom edge and spaced between the vertical side edges of said fourth flap;

said second flap having a cut-out section thereon having a horizontal bottom edge spaced from said fourth hinge line and a pair of spaced vertical side edges interconnected to said bottom edge of said second flap cut-out section on each side of said bottom edge and spaced between the vertical side edges of said second flap, said fourth hinge line being coincident with said third hinge line, and said cut-out sections of said second and fourth flaps being aligned when said fourth flap is folded along said fourth hinge line against said second flap; and a panel having an upper planar surface and a lower planar surface defined by an outer peripheral edge, said edge having a plurality of interconnected sides conforming in length to the width of said plurality of interconnected sides of said main body portion, one of said interconnected sides of said panel having a tab extending outwardly from said panel of a width generally the same as the width of the cut-out section of said third flap, another of said interconnected sides of said panel having a tab extending outwardly from said panel of a width generally the same as the width of the cut-out section of said fourth flap whereby, when said third and fourth flaps are folded about said third and fourth hinge lines, respectively, and said folded flaps are again folded about said first and second hinge lines, said cut-out sections of said first, second, third, and fourth flaps open upwardly, said tabs of said panel being disposed in said cut-out sections retaining said panel within said main body portion.

2. In the tube of claim 1 wherein said panel has a centrally disposed hole therein.

3. In the tube of claim 1 wherein one of said side edge of said fourth flap is connected to one of the side edges of said third flap.

4. In the tube of claim 1 wherein each of said interconnected sides of said main body portion has at least a first flap hingedly connected thereto.

5. In the tube of claim 1 wherein said first and second flaps are hingedly connected to the open top of said main body portion with said first and second flaps having said third and fourth flaps hingedly connected thereto, said first and second flaps also hingedly connected to the open bottom of said main body portion and with said first and second flaps having said third and fourth flaps hingedly connected thereto, and a second panel similar to said first mentioned panel disposed in the open bottom of said main body portion and retained therein when said bottom third and fourth flaps are folded against said bottom first and second flaps, respectively, and said bottom first and second flaps are subsequently folded into said open bottom.

6. In the tube of claim 5 including a centrally located hole in each of said panels, said holes being vertically aligned.

7. In the tube of claim 6 including a rotatable horizontal base having an upwardly extending vertical pole, said pole extending through said aligned holes thereby retaining said tube on said base.

8. In the tube of claim 1 including a plurality of elongated slots disposed at spaced locations on said main body portion.

* * * * *